US005476219A

United States Patent [19]

Kim

[11] Patent Number: 5,476,219

[45] Date of Patent: Dec. 19, 1995

[54] PACKING PAPER BOX

[75] Inventor: Do W. Kim, Seoul, Rep. of Korea

[73] Assignee: Dae Young Packing Co., Ltd., Kyungki-ko, Rep. of Korea

[21] Appl. No.: 274,076

[22] Filed: Jul. 12, 1994

[30] Foreign Application Priority Data

Apr. 21, 1994 [KR] Rep. of Korea ..... 1994-8399
May 31, 1994 [KR] Rep. of Korea ..... 1994-12175

[51] Int. Cl.[6] ..... B65D 5/56

[52] U.S. Cl. ..... 229/132; 220/418; 229/3.1; 229/198.2; 493/96; 493/162

[58] Field of Search ..... 229/132, 133, 229/3.1, 198.2; 220/418; 493/94, 96, 97, 162, 183

[56] References Cited

U.S. PATENT DOCUMENTS

| | | | |
|---|---|---|---|
| 2,196,243 | 4/1940 | Bensel | 229/132 |
| 2,305,371 | 12/1942 | Yates | 220/418 |
| 2,996,235 | 8/1961 | Turpin | 229/132 |
| 3,142,342 | 1/1939 | Bensel | 229/132 |
| 3,236,436 | 2/1966 | Cheeley | 220/418 |
| 3,355,081 | 11/1967 | Kachurchak | 220/418 |
| 4,139,119 | 2/1979 | McLaren | 220/418 |
| 4,771,938 | 9/1988 | Hambleton | 229/133 |

FOREIGN PATENT DOCUMENTS

| | | | |
|---|---|---|---|
| 176994 | 3/1922 | United Kingdom | 220/418 |
| 486656 | 6/1938 | United Kingdom | 229/132 |

*Primary Examiner*—Gary E. Elkins
*Attorney, Agent, or Firm*—Morgan & Finnegan

[57] ABSTRACT

A packing paper box with a moisture resistant band having a function to prevent a content from being leaked out of the paper box even when the paper box is partially deformed due to a careless handling during transportation or storage thereof. The moisture resistant band has a strip shape and is attached to junctions between the upper edges of vertical wall members of the paper box and the upper flap members of the paper box and between the lower edges of the vertical wall members and the lower flap members of the paper box. The moisture resistant band has a predetermined width and serves to sufficiently seal corners of the paper box upon folding the flap members. By virtue of the moisture resistant band, the packing paper box has a simple construction capable of providing both a moisture resistance and a durability.

15 Claims, 3 Drawing Sheets

PACKING PAPER BOX

BACKGROUND OF THE INVENTION

1. Field of the Invention

The present invention relates to a paper box for packing a solid detergent of powder or particles, and more particularly to a packing paper box with a moisture resistant band having a function to prevent a content from being leaked out of the paper box even when the paper box is partially deformed due to a careless handling during transportation or storage thereof.

2. Description of the Prior Art

Generally, packing paper boxes require an impact resistance, a durability and a watertightness because they must preserve their contents such as solid detergent and the like, in view of the distribution time of the products and the exhaustion time of the contents.

If a packing paper box has not the above-mentioned properties, it encounters several problems. Since the solid detergent packed in the box is in the form of fine particles, it may be easily agglomerated upon coming into contact with air or moisture penetrated from outside. In addition, the paper box is apt to be broken at its corner or edge by an impact possibly applied from outside during the transportation thereof or the distribution thereof, thereby causing its content to be outwardly discharged through a gap formed at the broken corner thereof.

In manufacture of the packing paper box, accordingly, a more precise corner formation is required. The dimension and shape of the corner being cut are also carefully determined. Recently, there has been used a multiple reinforcing member for providing a more firm paper box. However, this paper box encounters an increase in manufacture cost and an increase in weight due to the provision of the additional construction. Moreover, where the dimension of the additional construction does not conform with that of the paper box, it may be useless without accomplishing its intended purpose. This results in a disposition of the expensive material and thereby a deterioration in yield.

SUMMARY OF THE INVENTION

Therefore, an object of the invention is to eliminate the above-mentioned problems encountered in the prior art and, thus, to provide a packing paper box having a simple and improved construction capable of providing both a moisture resistance and a durability.

Another object of the invention is to provide a packing paper box capable of packing a liquid detergent as well as a powder detergent.

In accordance with the present invention, these object can be accomplished by providing a paper box for packing a detergent, comprising four vertical wall members constituting four vertical walls of the paper box, a coupling member outwardly extending from one-side outermost one of the vertical wall members and being bonded to the other-side outermost one of the vertical wall members, and a plurality of upper and lower flap members respectively extending from upper and lower edges of the vertical wall members and constituting upper and lower covers of the paper box, the paper box further comprising: a strip-shaped moisture resistant band attached to at least one of junctions between the upper edges of the vertical wall members and the upper flap members and between the lower edges of the vertical wall members and the lower flap members, the moisture resistant band having a predetermined width and serving to sufficiently seal corners of the paper box upon folding the flap members.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
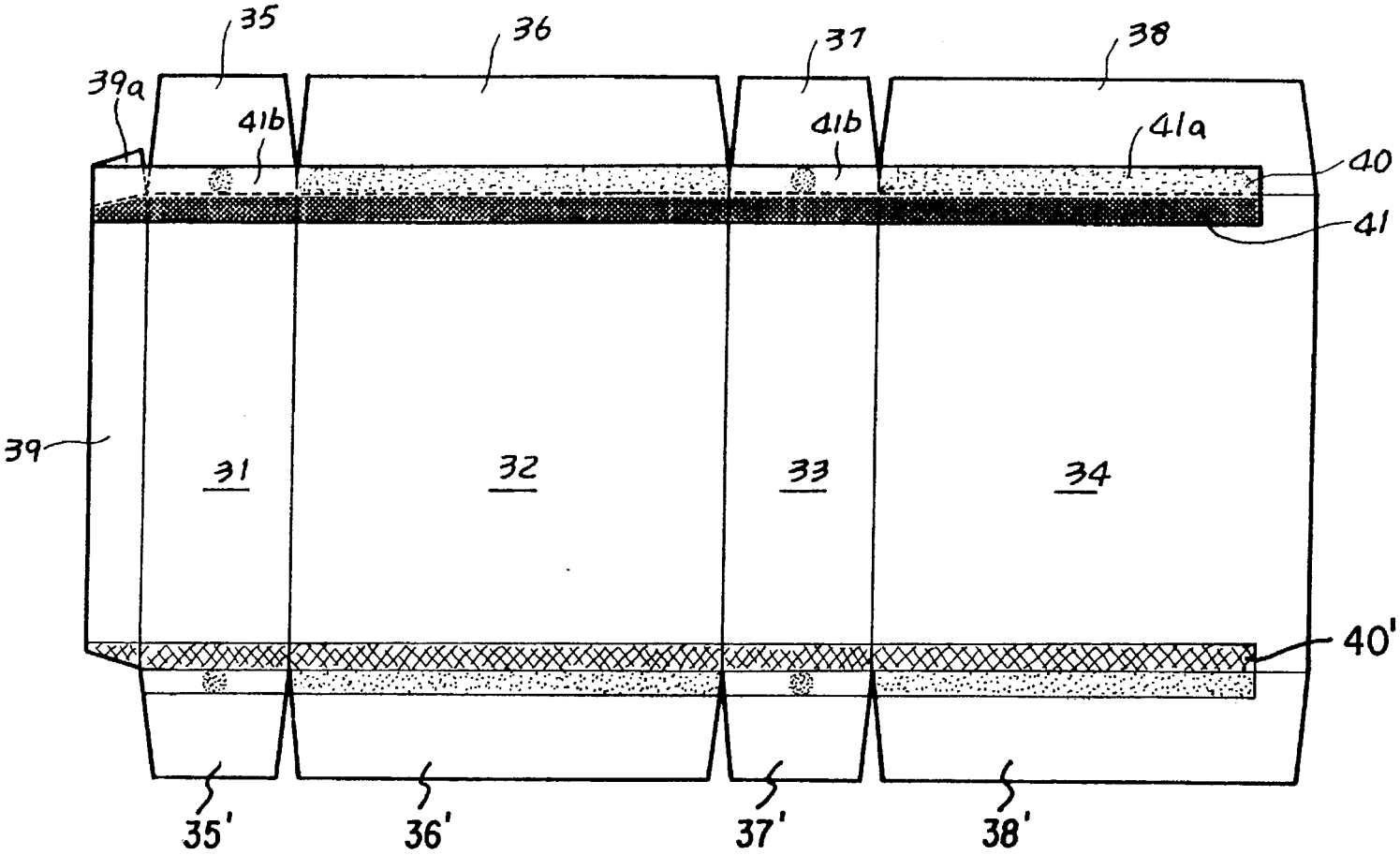
FIG. 1 plan view illustrating a developed condition of a packing paper box in accordance with an embodiment of the present invention.
Figure 2:
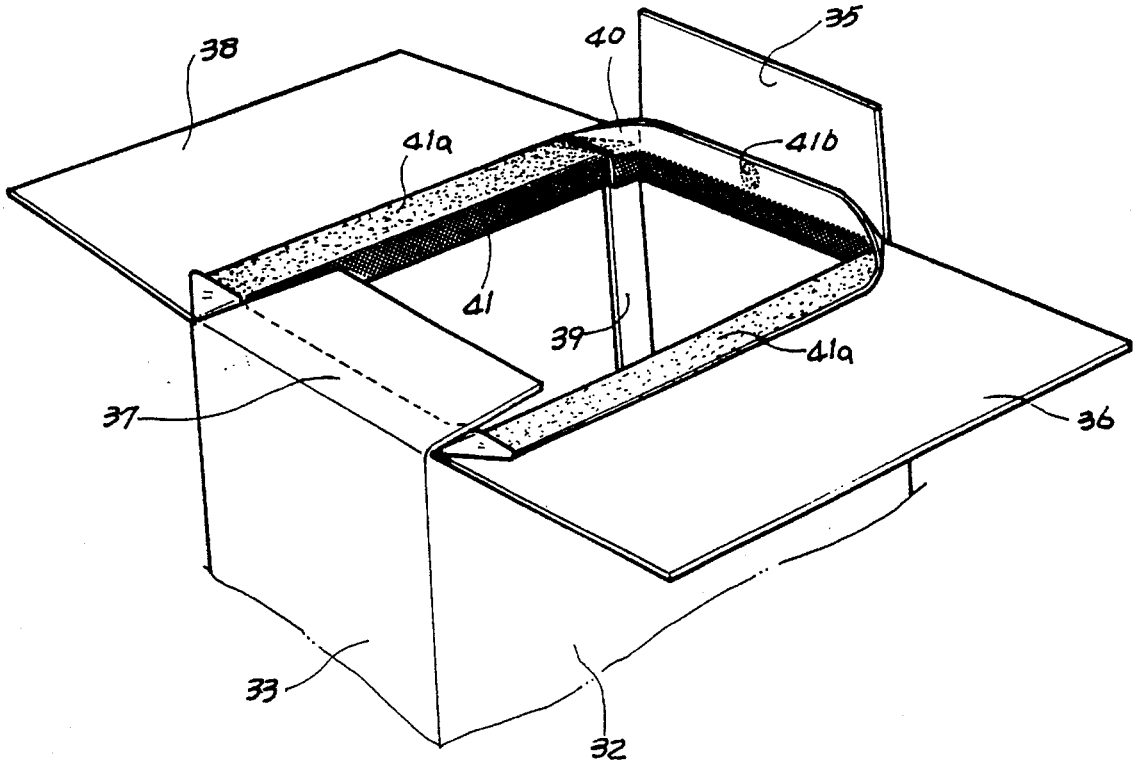
FIG. 2 is a perspective view illustrating a folded condition of the packing paper box of FIG. 1 for use.

Referring to FIGS. 1 and 2, there is illustrated a packing paper box in accordance with the present invention. FIG. 1 is a plan view illustrating a developed condition of the packing paper box in accordance with an embodiment of the present invention. FIG. 2 is a perspective view illustrating a folded condition of the packing paper box for use in accordance with the embodiment of the present invention.

As shown in FIGS. 1 and 2, the packing paper box of the present invention includes four vertical wall members 31 to 34 respectively constituting four vertical walls, as in conventional paper boxes. The packing paper box also includes a coupling member 39 outwardly extending from the outer vertical edge of the one-side outermost vertical wall member 31. Pairs of flap members 35 to 38 are provided at the vertical wall members 31 to 34, respectively. The flap members of each flap member pair extend outwardly from upper and lower edges of each corresponding vertical wall member. The flap members 35 to 38 are adapted to cover upper and lower openings defined upon assembling the paper box.

A pair of elongated moisture resistant bands 401 are provided at the upper junction between the upper edges of vertical wall members 31 to 34 and the upper flap members 35 to 38 and the lower junction between the lower edges of vertical wall members 31 to 34 and the lower flap members 351 to 381, respectively. Each of the moisture resistant bands 401 has a small width and adheres to the paper box body by means of an adhesive 41. These moisture resistant bands 40 serve to sufficiently seal the upper and lower edges of the paper box.

Each moisture resistant band 401 extends laterally from the outer edge of the coupling member 39 to a predetermined position of the other-side outermost vertical wall member 34 such that it surrounds completely the corresponding left, right, front and rear edges of the paper box folded. In other words, each moisture resistant band 40 extends throughout the lateral length of the paper box except for a portion of the vertical wall member 34 to be overlapped with the coupling member 39 upon holding. The adhesive 41 is applied only to the lower portion of each moisture resistant band 40.

To the upper portion of each moisture resistant band 40, an adhesive 41*a* is also applied at surfaces of the moisture resistant band 40 respectively coming into contact with the front and rear flap members 36 and 38. The adhesive 41*a* is not applied to opposite end portions of each surface of the moisture resistant band 40 coming into contact with each corresponding one of the front and rear flap members 36 and 38.

An adhesive 41*b* is applied to the central portion of each of the left and right flap members 35 and 37 so as to provide a local adhesive surface and thereby achieve an increase in watertightness.

Each moisture resistant band 40 which adheres to the corresponding junction, namely, folding line between the vertical wall members 31 to 34 and the flap members 35 to 38 to surround the four peripheral edges of the paper box is comprised of a strip tape for sealing limitedly the edges of the paper box.

Figure 3:
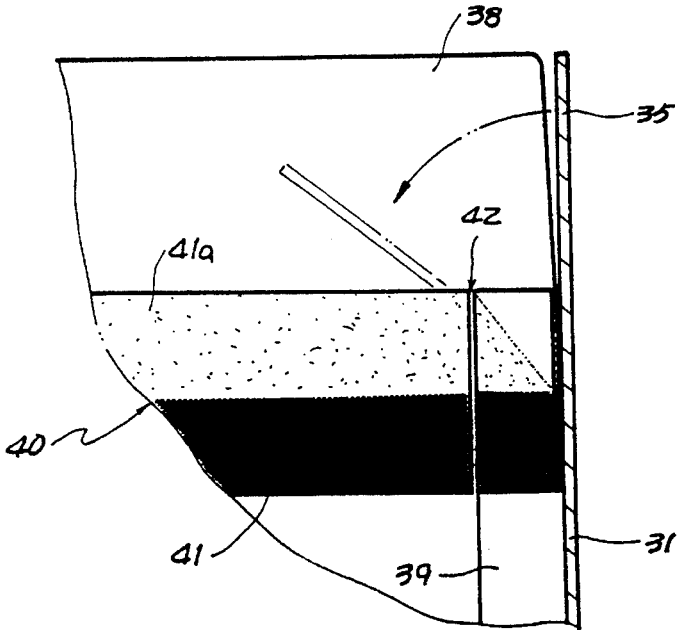
FIG. 3 is an enlarged view of a part of a moisture resistant band employed in the packing paper box in accordance with the present invention, illustrating both ends of the moisture resistant band.
Figure 4:
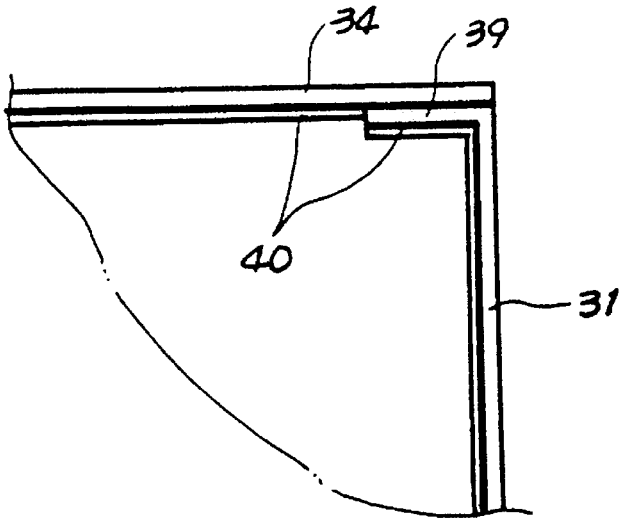
FIG. 4 is a plan view of the part shown in FIG. 3.

Although a gap may be generated between both ends of each strip-shaped moisture resistant band 40 upon folding the paper box, as shown in FIGS. 2 and 3, it does not serve to deteriorate the watertightness of the paper box because it is present at a region where the flap members 35 to 38 are overlapped with one another.

The coupling member 39 has a coupling piece 39*a* adapted to be overlapped with the flap member 38 extending from the upper edge of the vertical wall member 34 upon folding the paper box.

Upon assembling the packing paper box having the above-mentioned construction, first, the vertical wall members 31 to 34 and the coupling member 39 are sequentially folded. Thereafter, the coupling member 39 is bonded to the vertical wall member 34 such that its inner surface is in contact with the outer surface of the vertical wall member 34. At this time, the coupling piece 39*a* of the coupling member 39 is overlapped with the flap member 38.

Subsequently, the left and right flap members 35 and 37 are inwardly folded in a sequential manner. The front and rear flap members 34 and 36 are then outwardly folded such that the corresponding moisture resistant band 40 is folded at its portions constituting the corners of the paper box. Thereafter, the front and rear flap members 34 and 36 are inwardly folded in a sequential manner, thereby forming a desired assembled structure of the paper box.

When the left and right flap members 35 and 37 are inwardly folded, they serve to inclinedly fold the portions of the corresponding moisture resistant band 40 constituting the corners of paper box. Accordingly, it is possible to effectively avoid generation of a gap upon assembling the paper box without using any additional folding work.

Each moisture resistant band 40 provided fox effectively preventing outside air from coming into the gap formed at the paper box is required to have a waterproof property and a durability. Accordingly, the moisture resistant band 40 is preferably made of a book paper having a relatively high strength.

Since the front and rear flap members 36 and 38 are sequentially folded after inclinedly folding the portions of each moisture resistant band 40 by inwardly folding the left and right flap members 35 and 37, the folded portions of the moisture resistant band 40 are folded again.

At this time, the gap 42 formed between both ends of each moisture resistant band 40 upon folding is hidden by the portions of flap members 35 and 38 overlapped with each other. As a result, it is possible to obtain a good watertightness.

Although the illustrated embodiment of the present invention has been described in conjunction with a packing paper box made of a paper having a relatively small thickness, the present invention is not limited to the illustrated embodiment.

Figure 5:
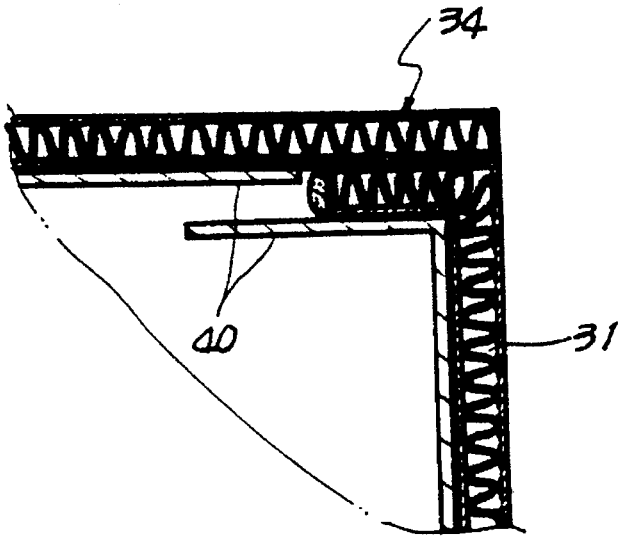
FIG. 5 is a plan view similar to FIG. 4, illustrating a packing paper box in accordance with another embodiment of the present invention.

Referring to FIG. 5, there is illustrated a packing paper box in accordance with another embodiment of the present invention applied to a corrugated cardboard box made of spaced cardboards including a corrugated member interposed therebetween. In this case, each moisture resistant band 40 extends beyond the outer edge of the coupling member 39 to have an extension at its one end. The extension is bonded to the other end of the moisture resistant band 40 upon assembling the paper box. As a result, it is possible to increase the watertightness.

In the case of FIG. 5, an adhesive may be applied to the outer edge of the coupling member 39 exposed to the interior of the paper box so that the edge of the coupling member 39 may be sealed. In this case, it is possible to seal the vertical walls of the paper box as well as the top and bottom of the paper box. Therefore, the paper box of this embodiment may be used to pack a liquid detergent.

Although the packing paper box of each of the illustrated embodiments has been described as including a pair of moisture resistant bands respectively provided at the upper and lower ends thereof, it may have only one moisture resistant band. Since the paper box containing a detergent is concentratively stressed at its bottom, the single moisture resistant band is preferably provided at the lower end of the paper box.

After assembling, the packing paper box exhibits a superior watertightness as well as an impact resistance and thereby provides a high reliability against an impact possibly generated during the transportation and distribution thereof.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A packing box blank comprising:

first, second, third and fourth interconnected vertical walls, an end coupling member connected along one side thereof to the first or fourth vertical wall, the tops of the walls defining a first horizontal straight line and the bottoms of the walls defining a second horizontal straight line, each one of the walls having an upper and a lower flap member, the upper flap members being foldably connected to respective walls along said first line, and the lower flap members being foldably connected to respective walls along said second line;

a first strip-shaped band extending horizontally across the blank along said first line with the bottom portion of the first band being continuously bonded with an adhesive to the top edges of the vertical walls, the top portion of the first band extending across said first line and being spot bonded with adhesive to the lower center portion of the upper flaps of the first and third vertical walls and bonded with a continuous strip of adhesive along substantially the whole bottom portion of the upper flaps of the second and fourth vertical walls.

2. The blank of claim 1 further comprising:

a second strip-shaped band extending horizontally across the blank along said second line with the top portion of the second band being continuously bonded with an adhesive to the bottom edges of the vertical walls, the bottom portion of the second band extending across said second line and being spot bonded with adhesive to the upper center portion of the lower flaps of the first and third vertical walls and bonded with a continuous strip of adhesive along substantially the whole upper portion of the lower flaps of the second and fourth vertical walls.

3. The blank of claim 1 wherein the first band is moisture resistant.

4. The blank of claim 2 wherein the first and second bands are moisture resistant.

5. The blank of claim 1 wherein the blank is composed of paper.

6. The blank of claim 1 wherein the blank is composed of corrugated cardboard.

7. The blank of claim 1 wherein the outer bottom portions of the upper flaps of the second and fourth vertical walls are not bonded to the top portion of the first band; whereby (a) the top portion of the first band is folded into corner-folds along angular lines extending upwardly and inwardly from the outer bottom corners of the upper flaps of the second and fourth vertical walls when the upper flaps of the second and fourth vertical walls are folded outwardly and the upper flaps of the first and third vertical walls are folded inwardly; and (b) the corner-folds are folded along said first line and over a respective one of the upper flaps of the first and third vertical walls when the upper flaps of the second and fourth vertical walls are folded forward.

8. The blank of claim 2 wherein the outer top portions of the lower flaps of the second and fourth vertical walls are not bonded to the bottom portion of the second band; whereby (a) the bottom portion of the second band is folded into coner-folds along angular lines extending downwardly and inwardly from when the lower flaps of the second and fourth vertical walls are folded outwardly and the lower flaps of the first and third vertical walls are folded inwardly; and (b) the corner-folds are folded along said second line and over a respective one of the lower flaps of the first and third vertical walls when the lower flaps of the second and fourth vertical walls are folded forward.

9. The blank of claim 1 wherein the bottom portion of the first band is bonded to the end coupling member.

10. The blank of claim 2 wherein the top portion of the second band is bonded to the end coupling member.

11. A method of forming a packing box with the blank of claim 1 comprising the steps of:

(a) folding the blank to position the first and second vertical walls in spaced opposition to the third and fourth walls, respectfully;

(b) bonding the end coupling member to the first or fourth vertical wall not already connected thereto to form a box opened at both ends thereof;

(c) folding the upper flaps of the second and fourth vertical walls outwardly to cause the band to fold over into corner-folds at the outer bottom portions of the upper flaps of the second and fourth vertical walls;

(d) folding the upper flaps of the first and third vertical walls inwardly; and (e) then folding the upper flaps of the second and fourth vertical walls inwardly, whereby the corner-folds are folded along said first line and over a respective one of the upper flaps of the first and third vertical walls to enclose the top of the box.

12. The method of claim 11 wherein step (c) and (d) are performed in sequence.

13. The method of claim 11 wherein step (c) follows step (d).

14. The method of claim 11 wherein the blank further comprises a second strip-shaped band extending horizontally across the blank along said second line with the top portion of the second band being continuously bonded with an adhesive to the bottom edges of the vertical walls and the end coupling member, the bottom portion of the second band extending across said second line and being spot bonded with adhesive to the upper center portion of the lower flaps of the first and third vertical walls and bonded with a continuous strip of adhesive along substantially the whole upper portion of the lower flaps of the second and fourth vertical walls, and wherein the method further comprises the steps of:

(f) folding the lower flaps of the second and fourth vertical walls outwardly to cause the second band to fold over into corner-folds at the outer top portions of the lower flaps of the second and fourth vertical walls;

(g) folding the lower flaps of the first and third vertical walls inwardly;

(h) then folding the lower flaps of the second and fourth vertical walls inwardly, whereby the corner-folds formed in step (f) are folded along said second line and over a respective one of the lower flaps of the first and third vertical walls to enclose the bottom of the box.

15. A packing box made in accordance with the method of claim 11.

* * * * *